US010017964B2

(12) United States Patent
Corwin, Jr.

(10) Patent No.: US 10,017,964 B2
(45) Date of Patent: Jul. 10, 2018

(54) LATCH MECHANISM FOR AN EXIT DEVICE

(71) Applicant: Hanchett Entry Systems, Inc., Phoenix, AZ (US)

(72) Inventor: Larry Gene Corwin, Jr., Mesa, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 182 days.

(21) Appl. No.: 14/749,810

(22) Filed: Jun. 25, 2015

(65) Prior Publication Data

US 2015/0376921 A1 Dec. 31, 2015

Related U.S. Application Data

(60) Provisional application No. 62/017,372, filed on Jun. 26, 2014.

(51) Int. Cl.

| | |
|---|---|
| ***E05B 65/10*** | (2006.01) |
| ***E05C 3/16*** | (2006.01) |
| ***E05B 47/02*** | (2006.01) |

(52) U.S. Cl.

CPC ..... *E05B 65/1053* (2013.01); *E05B 47/02* (2013.01)

(58) Field of Classification Search

CPC ..... E05B 65/1053; E05B 47/02

See application file for complete search history.

(56) References Cited

U.S. PATENT DOCUMENTS

| | | | | |
|---|---|---|---|---|
| 4,875,722 | A * | 10/1989 | Miller | E05B 65/1073 292/201 |
| 5,219,385 | A | 6/1993 | Yeh | |
| 6,048,000 | A * | 4/2000 | Geringer | E05B 47/0002 292/166 |
| 9,435,142 | B2 * | 9/2016 | Carpenter | E05B 47/0012 |
| 2004/0041412 | A1 * | 3/2004 | Cohrs, Jr. | E05B 65/1053 292/92 |
| 2004/0183311 | A1 | 9/2004 | Lin | |
| 2009/0107189 | A1 | 4/2009 | Lin | |
| 2015/0184426 | A1 | 7/2015 | Arlinghaus et al. | |

OTHER PUBLICATIONS

Byrne, Gerard, "United Kingdom Search Report," search completed Dec. 17, 2015, dated Dec. 18, 2015 for United Kingdom Application No. GB1511286.5, United Kingdom Intellectual Property Office.

* cited by examiner

*Primary Examiner* — Matthieu F Setliff
*Assistant Examiner* — Thomas L Neubauer
(74) *Attorney, Agent, or Firm* — Woods Oviatt Gilman LLP; Ronald J. Kisicki, Esq.

(57) ABSTRACT

A latch assembly is configured to be operable within a door latch system where the door latch system releasably secures a door in a door frame. The latch assembly comprises a housing and a latch pivotally mounted in the housing. The latch includes a lock-out feature. A translating bar is connected to the latch and is moveable by at least one actuation mechanism to selectively pivot the latch from an extended position wherein the door is secured in the door frame to a retracted position wherein the door is released from the door frame. A deadlatch is coupled to the latch. A bracket assembly is coupled to the latch and deadlatch, wherein the bracket assembly engages the lock-out feature when the deadlatch is in an engaged position to prevent pivoting of the latch.

14 Claims, 7 Drawing Sheets

LATCH MECHANISM FOR AN EXIT DEVICE

CROSS-REFERENCE TO RELATED APPLICATIONS

This application claims the benefit of U.S. Provisional Application No. 62/017,372, filed Jun. 26, 2014, which is hereby incorporated by reference in its entirety.

TECHNICAL FIELD

The present invention relates to a locking system for latching a hinged door into a frame; more particularly, to a latch assembly within the locking system, the latch assembly having a deadlatch to prevent unauthorized pivoting of a door latch; and most particularly, to a latch assembly wherein the deadlatch engages a lock-out feature on the door latch to lock the latch in its extended-lock position and wherein a ramp on the latch assembly disengages the lock-out feature and the deadlatch to allow the latch to move to its retracted-unlock position thereby permitting a user to open the door.

BACKGROUND OF THE INVENTION

Existing locking mechanisms such as strikes, locks, and rim exit devices incorporate mechanisms that use some type of locking element such as a keeper, a latch bolt, or a pullman style latch bolt. In unlocking, the locking element (referred to generically herein as a "latch") is required to rotate or retract out of the way of the mating locking element to reach a state of being unlocked. The latch may be mounted in a door and the mating locking element (referred to herein generically as a "strike" or "strike plate") may be mounted on a door frame, or vice versa, to equal effect.

Emergency exit doors typically employ what is commonly referred to as a panic bar to enable actuation of the locking mechanism so as to enable door opening. Panic bars allow users to open the door without necessarily requiring the use of their hands. Rather, the user's body can be used to push against the panic bar until the latch is retracted from the striker. Alternatively and additionally, exits doors may also include provision of an electrically actuable locking device such that, upon initiation, an electric current is supplied to the latch to withdraw the latch from the strike.

For electrified rim exit devices, such as those which utilize a panic bar, unlocking is typically achieved by utilizing an electromechanical device actuated by a solenoid or motor, to draw a pullman-style latch bolt out of or away from the strike to release the locked door. These electromechanical devices are typically very large in size, require numerous interconnected moving parts, are aesthetically unpleasing and require a large amount of power or current to actuate the unlocking mechanism.

What is needed in the art is a simplified locking device, and especially a simplified locking device that can fit within a limited amount of functional space but still meet the force requirements, either electrical or manual, of a design that has moving parts and some degree of complexity to resist easy defeat.

It is a principal object of the present invention to provide a compact locking device having simplified actuation of the latch to permit opening of the door, as well as securing the latch from unauthorized actuation when the latch resides with the strike.

SUMMARY OF THE INVENTION

Briefly described, a latch assembly is configured to be operable within a door latch system where the door latch system releasably secures a door in a door frame. The latch assembly comprises a housing and a latch pivotally mounted in the housing. The latch includes a lock-out feature such as a latch pin. A translating bar serves as the driving component, is connected to the latch and is moveable by at least one actuation mechanism to selectively pivot the latch from an extended position, where the door is secured in the door frame, to a retracted position, where the door is released from the door frame. A deadlatch is coupled to the latch. A bracket assembly is coupled to the latch and deadlatch, wherein the bracket assembly engages the latch pin when the deadlatch is in an engaged position to prevent pivoting of the latch.

In accordance with an aspect of the present invention, the bracket assembly includes a deadlatch arm engagable with the deadlatch when the latch pivots from the retracted position to the extended position so as to place the deadlatch in the engaged position.

In accordance with a further aspect of the present invention, the latch assembly further includes a biasing member connected to the housing and the translating bar to bias the translating bar to place the latch in the extended position.

In accordance with another aspect of the present invention, the at least one actuation mechanism is a panic bar. The panic bar may include a motor to actuate the translating bar and may include a bar position sensor.

In accordance with the present invention, the at least one actuating mechanism may include a rotatable drive member. The rotatable drive member includes a head portion adapted to engage a drive shaft of the at least one actuating mechanism and a finger portion configured to engage a drive pin on the translating bar to move the translating bar upon actuation of the drive shaft. A mounting plate may further be included wherein handedness of actuation of the drive shaft may be reversed by inverting the drive member and mounting plate end over end.

In accordance with a further aspect of the present invention, the drive shaft may include one or more external annular grooves so as to enable shortening of the drive shaft to accommodate doors of differing thickness. The drive shaft may be rotated by a manual actuator.

In accordance with another aspect of the present invention, the translating bar includes a ramp acting on the bracket assembly and configured to allow the latch to move toward its retracted-unlock position.

Numerous applications, some of which are exemplarily described below, may be implemented using the present invention.

BRIEF DESCRIPTION OF THE DRAWINGS

The present invention will now be described, by way of example, with reference to the accompanying drawings, in which.

Figures 1, 1A:
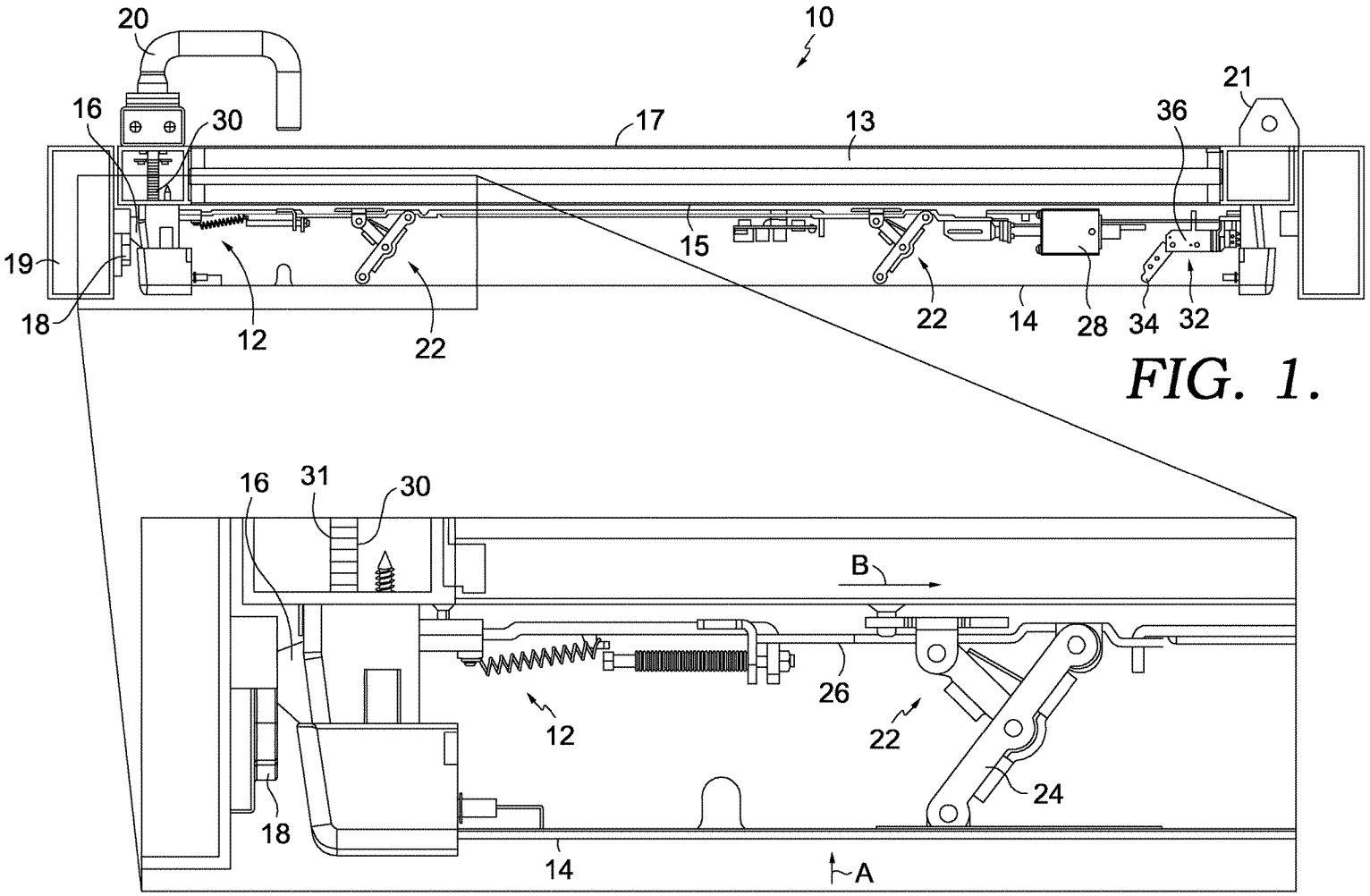
FIG. 1 is a side view of a locking system incorporating an embodiment of a latch assembly in accordance with the present invention.
FIG. 1A is a detailed view of the latch assembly shown in the locking system of FIG. 1.

Corresponding reference characters indicate corresponding parts throughout the several views. The exemplifications set out herein illustrate currently preferred embodiments of the present invention, and such exemplifications are not to be construed as limiting the scope of the invention in any manner.

DESCRIPTION OF THE PREFERRED EMBODIMENTS

Referring to FIGS. 1 and 1A, releasable locking system 10 is configured to include an embodiment 12 of a latch assembly in accordance with the present invention. In accordance with an aspect of the present invention, latch assembly 12 is configured to be operably mounted within a panic bar style actuating mechanism generally comprising a panic bar 14 mounted on a door 13. Depression of panic bar 14 operates to withdrawn latch 16 of latch assembly 12 from strike 18 which is secured in door frame 19. By way of example as shown in FIG. 1, panic bar 14 may be mounted to an unsecured side 15 of door 13, while a secured side 17 of door 15 carries another actuating mechanism in the form of a selectively lockable handle 20. That is, the unsecured side allows users to freely open the door upon actuation of the panic bar. Conversely, secured side 17 may be locked such that actuation of the handle may only be permitted after the handle is unlocked by a key, keycard, touch pad or other similar device known in the art.

In accordance with an aspect of the present invention, panic bar 14 may be coupled to one or more actuating members 22 having pivoting levers 24 and actuating bar 26. Movement of panic bar 14, such as in an actuating direction generally indicated by arrow A, pivots pivoting levers 24 thereby causing actuating bar 26 to translate in a latch unlocking direction B which is generally orthogonal to direction A thereby causing latch 16 to withdraw from strike 18, the mechanism of which will be discussed in greater detail below. Panic bar 14 may be actuated such as through manual depression of panic bar 14. Alternatively and/or additionally, panic bar 14 may be actuated by activation of an electromechanical device 28. It is envisioned that electromechanical device 28 may include a solenoid or motor, with activation initiated by a signal generated by a push-button, entry card, or other recognition device (none shown). Latch 16 may also be withdrawn through actuation of handle 20 whereby rotation of handle 20 operates to rotate shaft 30 which in turn withdraws latch 16, as will be discussed in greater detail below. In accordance with an aspect of the present invention, shaft 30 is configured to include one or more external annular grooves so as to enable shortening of the shaft so as to accommodate doors of different thickness.

The position of panic bar 14 may be monitored through an optional bar positioning monitor 32. Bar positioning monitor 32 may be used to monitor door security. For instance, bar position monitor 32 may include a pivoting arm 34 proximate the interior surface of panic bar 14 such that, when panic bar 14 is actuated (moved in direction A) the pivoting arm 34 is caused to move. Such movement may be interrogated by a sensor element 36. The sensor element 36 may be configured to issue an alarm signal should the panic bar be in an actuated position for a preselected length of time. This alarm signal may be an audio, visual or audiovisual alarm and/or may include an electronic signal transmitted to a remote security monitoring location. In this manner, building security may be alerted to the potential compromised security condition of locking mechanism 10.

Figure 2:
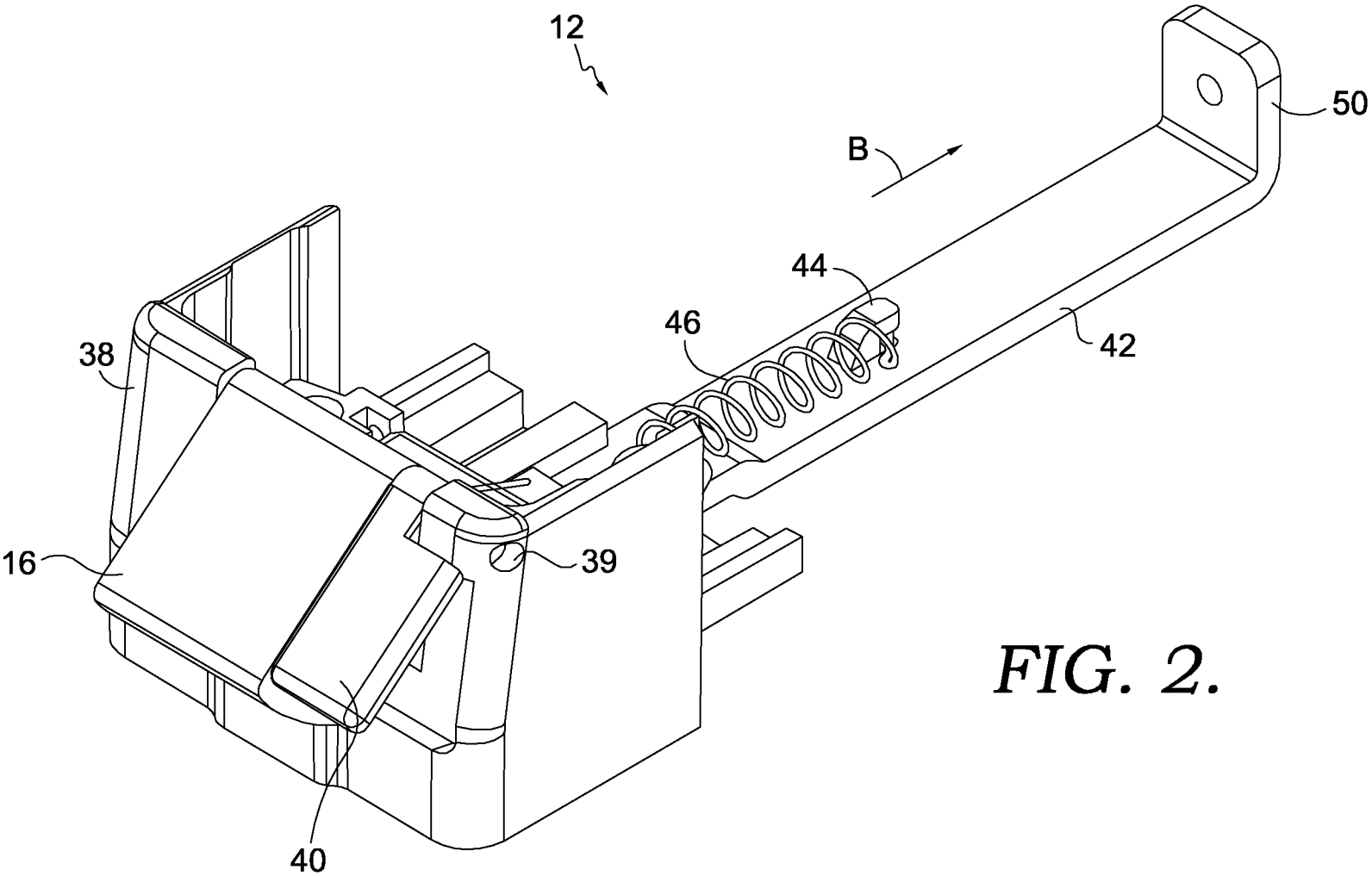
FIG. 2 is a perspective view of an isolated latch assembly in accordance with the present invention.
Figure 3A:
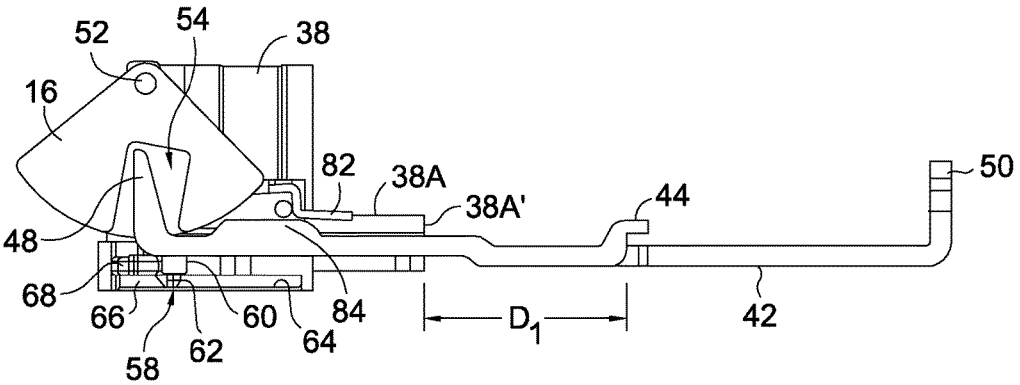
FIG. 3A is a cross-sectional view of the latch assembly shown in FIG. 2, wherein the latch assembly has the latch in the extended position.
Figure 3B:
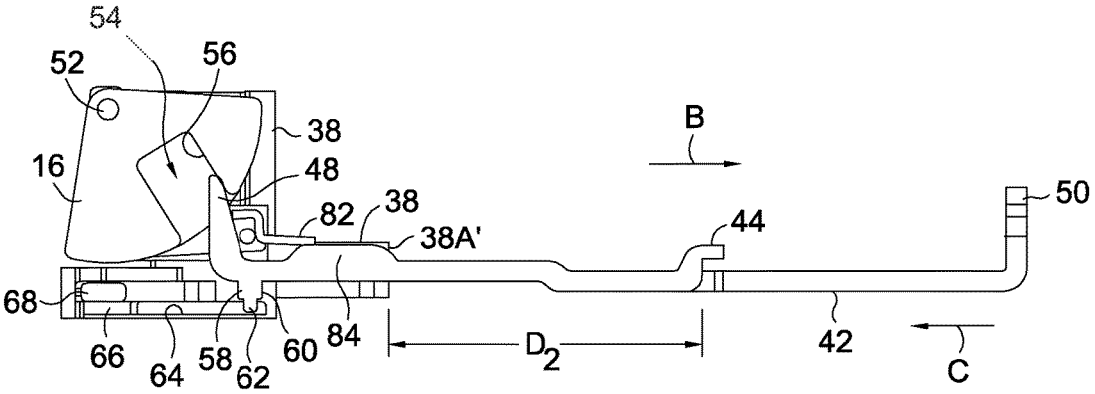
FIG. 3B is a cross-sectional view of the latch assembly shown in FIG. 2, wherein the latch assembly has the latch in the retracted position.
Figure 7A:
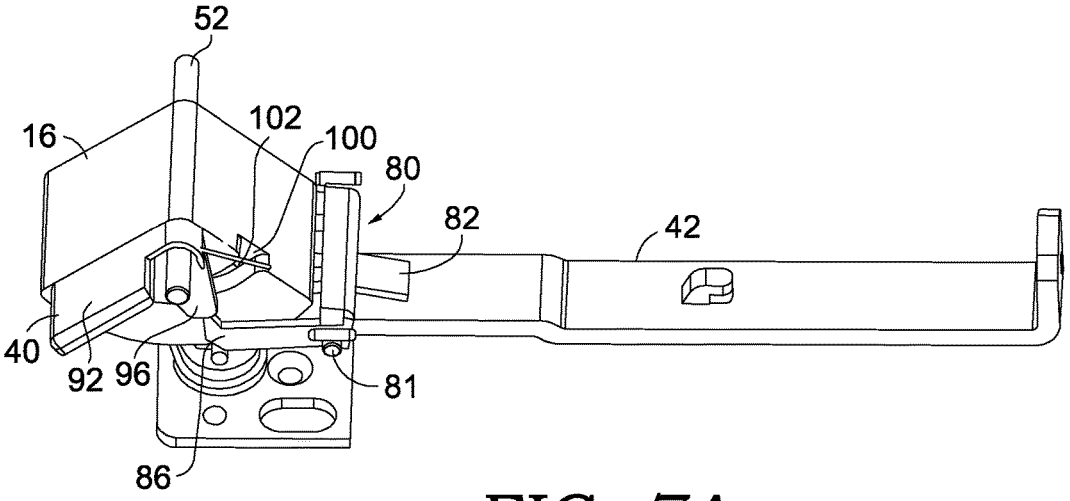
FIG. 7A is a left side perspective view of the latch assembly shown in FIG. 2 with the assembly housing removed and the deadlatch and latch in an extended position.
Figure 7B:
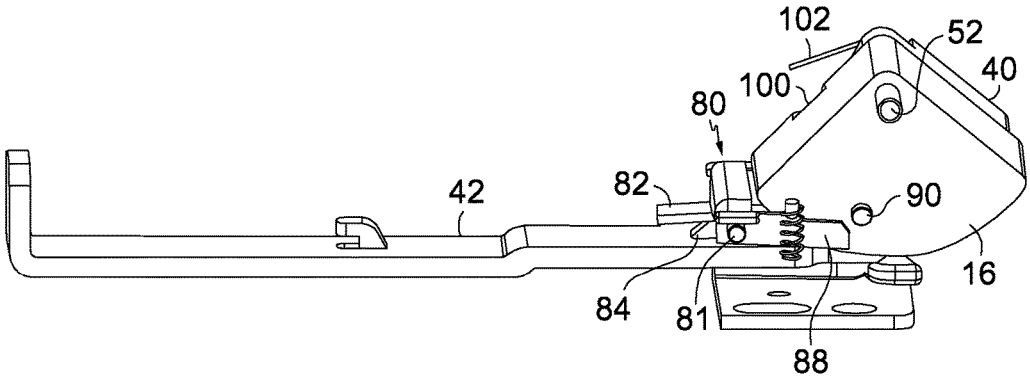
FIG. 7B is a right side perspective view of the latch assembly shown in FIG. 2 with the assembly housing removed and the deadlatch and latch in an extended position.
Figure 8A:
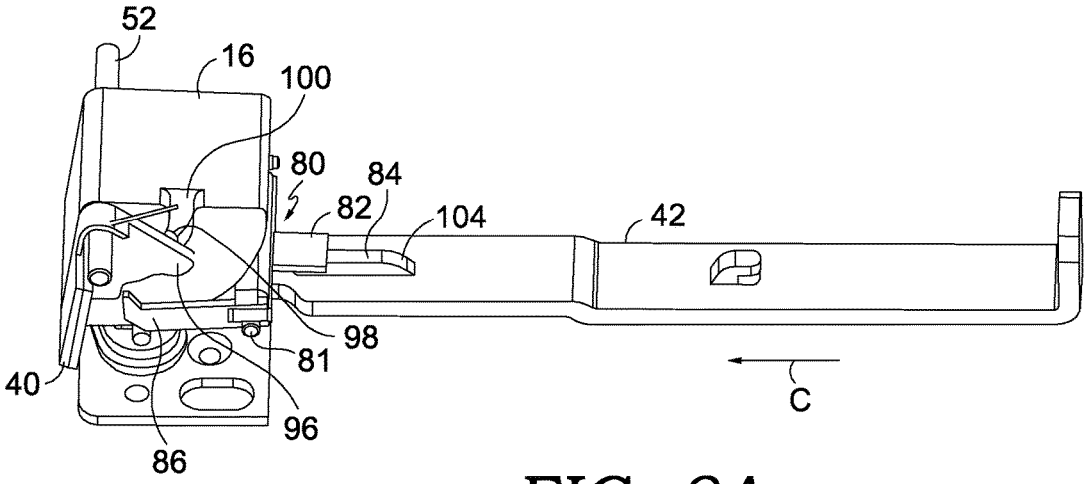
FIG. 8A is a left side perspective view of the latch assembly shown in FIG. 2 with the assembly housing removed and the deadlatch and latch in an fully retracted position.
Figure 8B:
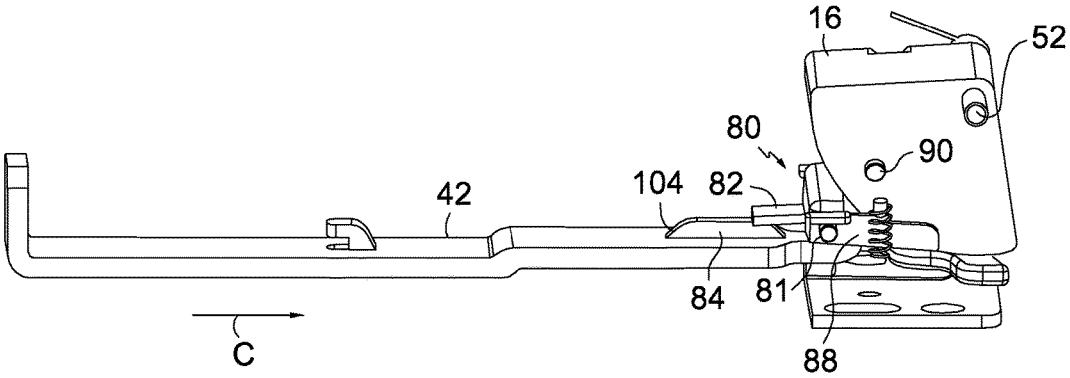
FIG. 8B is a right side perspective view of the latch assembly shown in FIG. 2 with the assembly housing removed and the deadlatch and latch in a fully retracted position.

Referring now to FIG. 2, shown is a perspective view of an isolated latch assembly 12 in accordance with an embodiment of the present invention. Latch assembly 12 generally comprises a latch housing 38 with latch 16 pivotally connected thereto by pivot pin 52 (see FIGS. 3A-8B) situated within a pivot hole 39 on latch housing 38. In a further embodiment of latch assembly 12, latch housing 38 may further include a deadlatch 40 coupled to latch 16 wherein deadlatch 40 is operable to prevent unwanted pivoting of latch 16 when latch 16 resides within strike 18. Translating bar 42 is operably engaged with latch 16 at a first end 48 (as shown in FIGS. 3A and 3B) and is configured to mount to actuating bar 26 at a second end 50. Movement of translating bar 42, such as in a direction parallel with latch unlocking direction B through actuation of actuating members 22 by panic bar 14 or actuation of handle 20, causes latch 16 and deadlatch 40 to move from an extended position (as shown in FIGS. 2, 7A and 7B) to a retracted position (as shown in FIGS. 8A and 8B). Translating bar 42 may further include a tongue 44. Tongue 44 is configured to engage one end of biasing member 46. The opposing end of biasing member 46 secured to housing 38 such that translating bar 42 is biased to place latch 16 in the extended position.

Turning now to FIGS. 3A and 3B, FIG. 3A is a cross-sectional view of latch assembly 12 showing latch 16 in the extended position while FIG. 3B is a cross-sectional view of latch assembly 12 showing latch 16 in the retracted position following actuation of panic bar 14. As can be seen in these figures, first end 48 of translating bar 42 is formed generally in the shape of a hook or other finger-like projection which extends generally orthogonal to the longitudinal plane of translating bar 42. In this manner, first end 48 rests within a pocket 54 defined within latch 16 (FIG. 3A). Upon actuation of panic bar 14 (or rotational actuation of handle 20 and shaft 30), first end 48 contacts inner surface 56 of pocket 54, where continued actuation of panic bar 14 (or handle 20) and the resultant linear travel of translating bar 42 along direction B causes latch 16 to pivot about pivot pin 52 so as to move latch 16 to the retracted position. With latch 16 in the retracted position, door 13 is freed from strike 18 such that door 13 is free to pivot about door hinge 21 (see FIG. 1).

As described above, a biasing member 46 (such as a coil spring as seen in FIGS. 1A and 2; not shown in FIGS. 3A and 3B) is secured to platform 38A on housing 38 at one end with the opposing end secured to translating bar 42 by way of tongue 44. As shown in FIG. 3A, when latch 16 is in the extended position, the trailing edge 38A' of platform 38A is a distance $D_1$ from tongue 44. Following actuation of panic bar 14 (or handle 20) and withdrawal of latch 16 to the retracted position (FIG. 3B), trailing edge 38A' is a distance $D_2$ from tongue 44, where distance $D_2$ is greater than $D_1$. The resultant elongation of biasing member 46 generates a restoring force within the biasing member. So long as the panic bar 14 or handle 20 is actuated to move translating bar 42 and place latch 16 in the retracted position, biasing member 46 will store the generated restoring force. Upon release of the panic bar or handle, the spring force is released causing translating bar to move in the opposite direction (such as in direction C) which in turn displaces first end 48 from inner surface 56 of pocket 54 and allows latch 16 to return to the extended position such as that shown in FIG. 3A.

Figure 4:
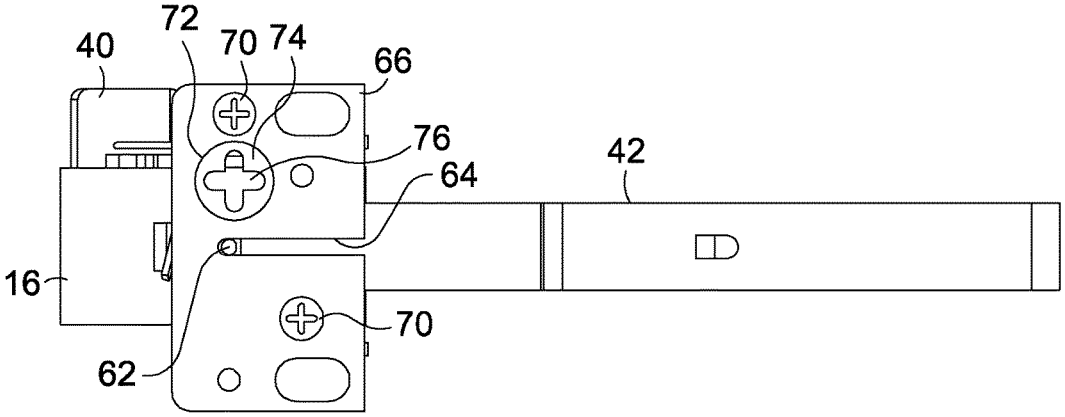
FIG. 4 is a bottom view of the latch assembly shown in FIG. 2 with the assembly housing removed.
Figure 5:
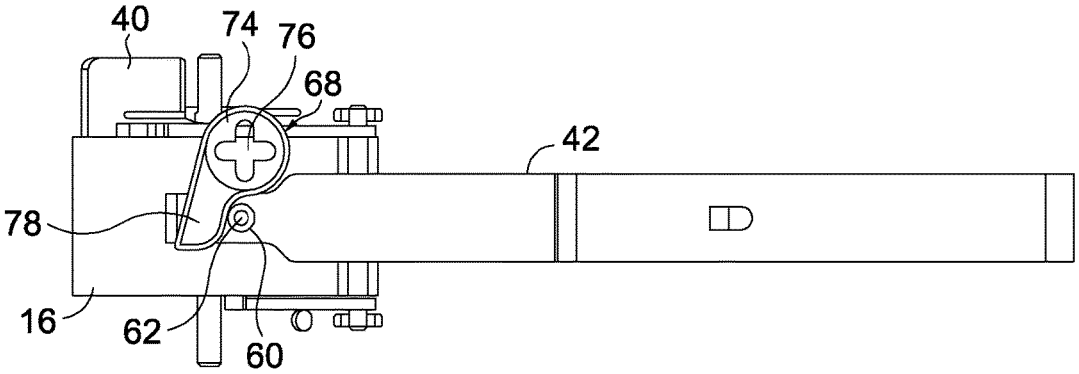
FIG. 5 is a bottom view of the latch assembly shown in FIG. 2 with the assembly housing and base plate removed.

As can be seen within FIGS. 3A and 3B, and as further shown in FIGS. 4 and 5, translating bar 42 may further include a downwardly extending stepped projection 58 having a wide base portion 60 and nipple end 62. Nipple end 62 is configured to slide within a groove 64 in base plate 66 (see FIG. 4). Base portion 60 is adapted to engage a driving member 68 which is coupled to shaft 30 (see FIG. 5). In accordance with an aspect of the present invention, base plate 66 is reversibly mounted to housing 38 by screws 70. Base plate 66 includes a hole 72 configured to accept head portion 74 of driving member 68. Head portion 74 includes a figured slot 76 which is adapted to cooperate with a terminal end of shaft 30. Driving member 68 further includes a finger region 78. Finger region 78 is configured to engage wide base portion 60 on projection 58 of translating bar 42 such that actuation of shaft 30 in figured slot 76 rotates finger region 78 against base portion 60 to drive translating bar 42 and pivot latch 16 from the extended position to the retracted position as described above.

In accordance with a further aspect of the present invention, the handedness of rotation of handle 20 and shaft 30 can be reversed by inverting driving member 68 and base plate 66 in an end-over-end fashion. For instance, as shown in FIGS. 4 and 5, head portion 74 is positioned above projection 58 on translating bar 42. In this position, counterclockwise rotation of drive member 68 operates to drive translating bar 42. Plate hole 72 in base plate 66 is correspondingly arranged to lie above projection 58 and accept head potion 74. Flipping drive member 68 end over end places head portion 74 below projection 58 with finger region 78 remaining on the left. In this orientation, clockwise rotation of drive member 68 operates to drive translating bar 42. Again, base plate 66 would also be flipped so that hole 72 once again corresponds with head portion 74.

Figure 6A:
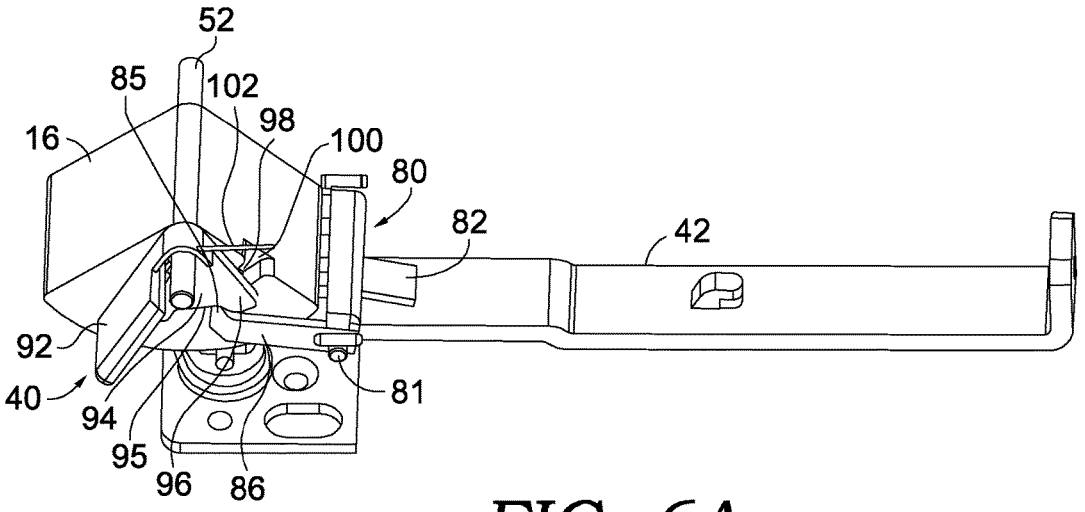
FIG. 6A is a left side perspective view of the latch assembly shown in FIG. 2 with the assembly housing removed and the deadlatch in an engaged position.

Referring now to FIGS. 6A through 8B, examples of the operational relationship between deadlatch 40 and latch 16 are shown. FIGS. 6A and 6B illustrate engagement of deadlatch 40 which is representative of the situation wherein locking system 10 is secured within strike 18, whereby deadlatch 40 is held in its engaged position by its engagement with a surface on the strike 18, such as that shown in FIG. 1. As can been seen in the figures, deadlatch 40 is pivotally engaged with latch 16 through shared pivot pin 52. Engagement of deadlatch 40 prevents unauthorized rotation of latch 16 as will be discussed in more detail in the following description.

Coupled to deadlatch 40 and latch 16 is bracket assembly 80. Bracket assembly 80 is pivotally secured within housing 38 at a bracket pivot 81 and includes a ramp plate 82 configured to selectively engage ramp 84 on translating bar 42 (see also FIGS. 3A and 3B). Bracket assembly 80 further includes a deadlatch arm 86 and pawl 85 wherein pawl 85 is configured to engage a latch surface 94 of deadlatch 40. Deadlatch arm 88 is configured to selectively engage with a lock-out feature such as latch pin 90 located on latch 16. Deadlatch 40 includes a strike surface 92 and latch surface 94 wherein strike surface 92 may pivotally engage strike 18 upon relatching of locking system 10 to assist in placing deadlatch 40 in the engaged position. Latch surface 94 of deadlatch 40 includes a null portion 95 and a lobe portion 96 adapted to be selectively engaged by pawl 85 of deadlatch arm 86. Latch surface 94 further includes an inwardly facing nodule 98 which slidably travels within channel 100 on latch 16 to guide the rotation of deadlatch 40.

A biasing member 102 biases deadlatch 40 toward a disengaged position (disengaged position shown in FIGS. 7A and 8A).

Figure 6B:
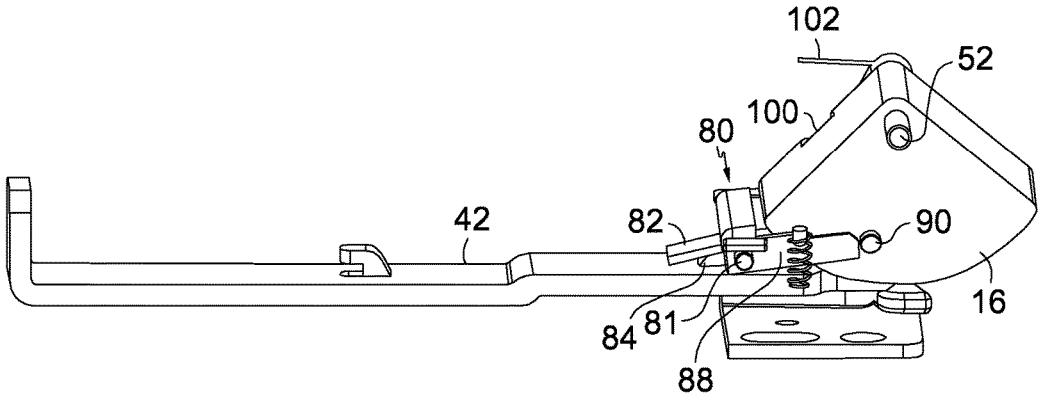
FIG. 6B is a right side perspective view of the latch assembly shown in FIG. 2 with the assembly housing removed and the deadlatch in an engaged position.

FIGS. 6A and 6B general illustrate latch assembly 12 with deadlatch 40 in its engaged position, pawl 85 aligned with null portion 95 and latch 16 in its extended-lock position. As shown in FIG. 6B, when panic bar 14 or handle 20 is not actuated and deadlatch 40 is engaged, bracket assembly 80 is disposed about pivot 81 such that latch arm 88 aligns with and impacts latch pin 90. As a result of this interaction, the rotation of latch 16 is blocked and the latch is prevented from rotating about latch pivot 52 thereby securely locking latch 16 within strike 18.

FIGS. 7A and 7B generally illustrate latch assembly 12 upon an initial authorized actuation of panic bar 14 or handle 20. As actuation of either of these mechanisms begins, ramp 84 slidably engages ramp plate 82 on bracket assembly 80. Engagement of ramp plate 82 causes bracket assembly 80 to rotate about pivot 81. This rotation, in turn, simultaneously disengages latch arm 88 from latch pin 90 on latch 16, thereby permitting latch 16 to rotate out of engagement with strike 18. The rotation of bracket assembly 80 by ramp plate 82 also causes pawl 85 to move out of engagement with null portion 95 of latch surface 94. Biasing member 102 then releases its stored biasing force and rotates deadlatch 40 toward the position shown in FIG. 7A, thereby causing pawl 85 to align with lobe portion 96 of latch surface 94 and to hold latch arm 88 out of alignment with latch pin 90. Channel 100 is dimensioned such that nodule 98 travels within channel 100 until strike surface 92 on deadlatch 40 coincides with the external face of latch 16 so as to create a generally coplanar surface. Thus, latch 16 and deadlatch 40 may freely rotate about pivot pin 52 as long as latch arm 88 remains misaligned with latch pin 90.

FIGS. 8A and 8B generally illustrate latch assembly 12 after full actuation of panic bar 14 or handle 20 whereby latch 16 and deadlatch 40 have been rotated about pivot pin 52 to the fully retracted position by translating bar 42 and door 13 is unlocked from strike 18 and door frame 19. Again, nodule 98 rests within channel 100 and is driven by latch 16 during translation of translating bar 42 so as to maintain the coplanar striker surfaces of latch 16 and deadlatch 40. As can be further seen, ramp 84 on translating bar 42 continues to engage ramp plate 82 on bracket assembly 80 so as to rotate bracket assembly about pivot 81 such that deadlatch arm 86 and latch arm 88 are disengaged from their respective deadlatch 40 and latch 16.

As discussed above, upon release of the actuation force applied to either panic bar 14 or handle 20, biasing member 46 (see FIGS. 1A and 2) restores latch 16 to the extended position (such as that shown in FIGS. 6A and 6B). While latch 16 may be fully restored to its extended position, lobe 96 of deadlatch 40 is captured by the engagement of pawl 85 with null portion 95 so as to place deadlatch 40 in the engaged position as shown in FIGS. 6A and 6B. More specifically, as translating bar 42 travels along direction C due to the restoring force of biasing member 46, ramp plate 82 on bracket assembly 80 rides along ramp 84 on translating bar 42. Once ramp plate 82 encounters curved terminal end 104 of ramp 84, ramp plate 82 reverse pivots about pivot 81 such that pawl 85 once again encounters null portion 95 of latch surface 94. At the same time, latch arm 88 once again interferes with latch pin 90 to prevent free rotation of latch 16. Latch 16 and deadlatch 40 may then be resecured within strike 18 with deadlatch 40 in the engaged position to assist in preventing unauthorized opening of door 13.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A latch assembly configured to be operable within a door latch system, the door latch system releasably securing a door in a door frame, the latch assembly comprising:

a) a housing;

b) a latch pivotally mounted in the housing and moveable in a latch unlocking direction between a latch extended position and a latch retracted position, the latch including a lock-out feature;

c) a deadlatch pivotally mounted in the housing and movable between a deadlatch extended position and a deadlatch retracted position;

d) a translating bar operably engaged with said latch and linearly moveable by at least one actuating mechanism to selectively pivot the latch from the latch extended position when the door is secured in the door frame to the latch retracted position so that the door is releasable from the door frame, wherein said linear movement of said translating bar is parallel with said latch unlocking direction of said latch; and e) a bracket assembly operatively coupled to the latch and deadlatch, wherein the bracket assembly engages the lock-out feature when the deadlatch is in an engaged position to prevent pivoting of the latch from the latch extended position when said door is secured in said door frame.

2. The latch assembly of claim 1 wherein the bracket assembly includes a deadlatch arm to capture the deadlatch when the latch pivots from the latch retracted position to the latch extended position so as to place the deadlatch in the engaged position.

3. The latch assembly of claim 1 and further including a bar biasing member connected to the housing and the translating bar to bias the translating bar to place the latch in the latch extended position.

4. The latch assembly of claim 1 wherein the at least one actuating mechanism is a panic bar.

5. The latch assembly of claim 4 wherein the panic bar includes a bar position sensor.

6. The latch assembly of claim 1 wherein the at least one actuating mechanism includes a rotatable drive member.

7. The latch assembly of claim 6 wherein the rotatable drive member includes a head portion configured to engage a drive shaft of the at least one actuating mechanism and a finger portion configured to engage a drive pin on the translating bar to move the translating bar upon actuation of the drive shaft.

8. The latch assembly of claim 6 and further including a mounting plate wherein handedness of actuation of the drive shaft is configured for being reversed by inverting the drive member and mounting plate end over end.

9. The latch assembly of claim 6 wherein the rotatable drive member is configured to engage a drive shaft and said drive shaft includes one or more external annular grooves so as to enable shortening of the drive shaft to accommodate doors of differing thickness.

10. The latch assembly of claim 1 wherein the translating bar includes a ramp engageable with said bracket assembly and configured to disengage the deadlatch from the engaged position upon actuation of the at least one actuating member wherein, when said bracket assembly engages said ramp, said bracket assembly is misaligned with said lock-out feature and said latch is permitted to disengage from an associated strike.

11. The latch assembly of claim 1 wherein said lock-out feature is a latch pin.

12. The latch assembly of claim 1 wherein the translating bar includes a ramp, wherein the bracket assembly includes a plate, and wherein, when the linear movement of the translation bar causes engagement between the ramp and the plate, the latch is permitted to pivot from the latch extended position to the latch retracted position.

13. A latch mechanism configured to be operable within a door latch system, the door latch system releasably securing a door closed in a door frame, the latch assembly comprising:

a) a housing;

b) a latch having a lock-out feature, wherein said latch is pivotally connected to said housing and moveable in a latch unlocking direction between a latch extended position and a latch retracted position, and wherein, when said latch is in said latch extended position and said door is closed, said door is secured in said door frame;

c) a deadlatch pivotally connected to said housing and movable between a deadlatch engaged position and a deadlatch disengaged position, wherein, when said deadlatch is in said deadlatch engaged position, said latch is prevented from movement away from said latch extended position;

d) a translating bar movably attached to said housing and operatively engaged with said latch, wherein said translating bar is linearly moveable by at least one actuating mechanism in a first direction to selectively pivot said latch from said latch extended position to said latch retracted position, and wherein said linear movement of said translating bar is parallel with said latch unlocking direction; and e) a bracket assembly having a first arm selectively engageable with said lock-out feature and movable by said translating bar between a bracket assembly engaged position and a bracket assembly disengaged position, wherein, when said bracket assembly is in said bracket assembly engaged position, said first arm engages said lock-out feature to prevent movement of said latch away from said latch extended position.

14. The latch mechanism in accordance with claim 13 wherein said translating bar includes a ramp and said bracket assembly includes a second arm, and wherein, when said translating bar is moved in said first direction, said ramp contacts said second arm and said first arm disengages from said lock-out feature to permit movement of said latch away from said latch extended position.

* * * * *